United States Patent [19]

Newell

[11] Patent Number: 4,995,133

[45] Date of Patent: Feb. 26, 1991

[54] MOP HEAD COMPRISING CAPACITIVE WEB ELEMENTS, AND METHOD OF MAKING THE SAME

[76] Inventor: Robert D. Newell, 429 N. Main St., Roxboro, N.C. 27973

[21] Appl. No.: 505,062

[22] Filed: Apr. 5, 1990

Related U.S. Application Data

[63] Continuation-in-part of Ser. No. 189,484, May 2, 1988, Pat. No. 4,923,738.

[51] Int. Cl.[5] ..... A47L 13/20

[52] U.S. Cl. ..... 15/229.001; 300/21; 15/226; 15/228

[58] Field of Search ..... 300/21; 428/37, 221; 15/229.1, 228, 229.5, 229.9, 98, 226

[56] References Cited

U.S. PATENT DOCUMENTS

| | | | |
|---|---|---|---|
| 891,744 | 6/1908 | Stocker | 300/21 |
| 1,855,400 | 4/1932 | Krebs | 15/229.1 |
| 1,993,215 | 3/1935 | Hoyt et al. | 300/21 |
| 2,035,130 | 3/1936 | Klawans | 15/229.1 |
| 2,231,272 | 2/1942 | Klawans | 15/229.1 X |
| 2,300,821 | 11/1942 | Weaver et al. | 15/229.1 X |
| 3,115,658 | 12/1963 | Moss | 300/21 X |
| 3,453,677 | 7/1969 | Cutler | 15/228 X |
| 3,520,017 | 7/1970 | Moss | 15/229 |
| 3,827,099 | 8/1974 | Allaire et al. | 15/229.1 |
| 4,114,224 | 9/1978 | Disko | 15/229 |
| 4,227,277 | 10/1980 | McNelley, Jr. | 15/229.1 |
| 4,313,774 | 2/1982 | Arthur | 156/73.1 |
| 4,717,616 | 1/1988 | Harman | 428/195 |
| 4,752,985 | 6/1988 | Quearry et al. | 15/229.1 |

FOREIGN PATENT DOCUMENTS

| | | | |
|---|---|---|---|
| 924880 | 8/1947 | France | 15/226 |

OTHER PUBLICATIONS

Cotton/Growth in Nonwovens, Naturally, Jacobsen, Michael, Ed., Nonwovens Industry, Jun. 1989, pp. 26–30.

Fibers for Nonwovens/Another Record Year for Staple Shipments Fibers for Nonwovens, Harrison D., Jun. 1989, pp. 20–24.

Monahan's Miracle Mopster TM /The Mop Yarn of the 90's, The Thomas Monaham Co., Box 250 Arcola, Ill. 61910.

One System . . . System 1 TM /The Flat Mopping Concept, Wilen Manufacturing Co., Ga.

*Primary Examiner*—Frankie L. Stinson

*Attorney, Agent, or Firm*—Steven J. Hultquist

[57] ABSTRACT

A mop head comprising a plurality of web elements having involutions therein. The involutions may be formed by treatment conditions comprising successive tensioning/detensioning, compression, differential stressing or stretching, twisting, or combinations of these or other conditions or treatments imparting involutions to the web elements. In a preferred aspect, the web elements are formed of a non-woven material comprising a cellulose and synthetic fiber blend. Mop heads of the invention are usefully employed in dry mopping and/or wet mopping applications.

27 Claims, 5 Drawing Sheets

MOP HEAD COMPRISING CAPACITIVE WEB ELEMENTS, AND METHOD OF MAKING THE SAME

CROSS-REFERENCE TO RELATED APPLICATION

This is a continuation-in-part of U.S. application Ser. No. 189,484 filed May 2, 1988, and issued May 8, 1990 as U.S. Pat. No. 4,923,738.

BACKGROUND OF THE INVENTION

1. Field of the Invention

This invention relates to a mop head comprising a plurality of web elements, and to a method of making same.

More specifically, the present invention relates to a mop head comprising fibrous web elements for the retention of solids and/or fluids, for dry-mopping and/or wet-mopping applications. The web elements of the mop head are structured to provide three-dimensional configurations including involutions providing enhanced holding ability (capacitance) for the retention and subsequent release of particulates and/or fluids.

2. Description of the Related Art

The raw materials employed in mop head yarn elements can be of many different types. There are primarily two different types of fibers in common use in such yarn elements, cellulose-based fibers and petroleum-based fibers. Cellulose-based fibers used in this industry are typically cotton or rayon fibers. The most common petroleum-based fibers employed in mop applications are polypropylene, polyester, and nylon fibers. Cellulose fibers are generally derived from natural resources without chemical restructuring of their properties, as is typical of most synthetics.

Mop yarns may also comprise miscellaneous fibers of undetermined origin, in addition to cotton or rayon. These miscellaneous fibers may be a blend of fibers which are produced as a by-product of manufacturing processes in textile mills running virgin raw materials. As these mills produce end products such as denim, sheeting, towels, etc., the process machinery throw off fibers and trimmings waste which are assimilated through various collection devices to be baled and reused or sold. This waste fiber by-product has approximately the same fiber composition as the end product being manufactured.

A prevalent raw material used for the manufacture of mop yarn is 100% cotton fiber. This fiber is generally used in three different types: (1) virgin cotton; (2) gin motes or gin mote blends; and (3) waste of 100 % cotton.

Virgin cotton is cotton produced by the ginning process, with no reprocessing being involved. For mop yarn this virgin cotton generally is lower grade cotton such as good ordinary or below grade class, and may contain shorter, less mature fibers, or naturally stained fibers which may contain a greater amount of leaf, stick or stem than higher grades of cotton.

Gin motes are one of the by-products generated by the cotton ginning process. These by-products comprise the fibers separated from the virgin cotton when it is cleaned in the cotton gin. The quality of the gin mote fibers is directly related to the quality of the virgin cotton being ginned. If the cotton being ginned is of higher classes of quality, then the gin motes will consist of better quality fibers. However, if the gin motes are not reprocessed prior to the manufacture of yarn therefrom, a yarn will be processed which has an extremely high trash content, e.g., leaf, stick and stem particles included in the fibers. As a result, most mop yarn manufacturers reprocess the raw gin motes into cleaned-up gin mote blends.

Waste of 100% cotton is used very little in the manufacture of mop yarn because of its limited supply.

Another cellulose-based raw fiber material which is widely employed in the manufacture of mop yarn is rayon. Rayon is a viscose fiber produced primarily from wood pulp or other sources of regenerated cellulose. This fiber is produced by dissolving purified cellulose using certain solvents and chemical baths for hardening. After hardening, it is cut to staple lengths. The diameter of the fiber can vary and it is denoted by its direct relation to weight.

Most mop yarns are formed of cellulosic or other natural materials, or else of natural/synthetic blends. Synthetic (e.g., petroleum-based) fibers are not generally used alone in mop head applications for wet-mopping usage, for the reason that many synthetic fibers cannot absorb water, but rather must rely on their capillary reaction to liquids. This means that the yarn must be sufficiently porous to permit the moisture to diffuse between the fibers and be held between the fibers in a clinging manner. The positive aspects of synthetic fibers for mop head application include their strength, high wearability, and limited shrinkage characteristics. In many mopping applications, the mop head may suitably employ mop yarn of only synthetic fibers. An oil mop of such type is disclosed in U.S. Pat. No. 3,748,682.

The general characteristics desirable for mop yarns and fiber structures in mopping applications include:

(1) high durability and abrasion resistance;

(2) high absorption characteristics as demonstrated by soft, e.g., loosely twisted yarns;

(3) ready driability;

(4) high wet tensile strength; and (5) the ability to withstand repeated launderings and not shrink significantly, with characteristics (1) and (5) being important in both wet mopping as well as dry mopping applications, while characteristics (2), (3), and (4) are desirable for wet-mopping applications.

U.S. Pat. No. 4,717,616 issued Jan. 5, 1988 to A. D. Harmon, et al discloses a mop head construction comprising a plurality of substantially parallel, abutting strands of textile material, such as roving, or cords of twisted strands and yarns. The main deficiency of this product lies in the fact that absorption is being accomplished through the use of capillary action exhibited by very finely divided fibrous structures possessing a low fluid pick-up and retention capacity on a unit volume basis, thereby physically limiting the amount of fluids, e.g., liquids, or mixtures of liquids and particulates, that can be absorbed per unit volume. Further, due to its large surface area per unit volume, the renewability and driability of this type of fabric is poor. The fluid that is taken up by such mop head is not readily released, so that the sorptive capacity which initially is present is not efficiently used after liquid is taken up, until the fibrous structure dries by evaporation of the retained fluid.

U.S. Pat. No. 4,313,774 issued Feb. 2, 1982 to J. P. Arthur describes a mop head made of a non-woven fabric of a cellulose and synthetic fiber blend which is made by combining plural non-woven continuous fabric sheets in a composite superimposed stack, ultrasonically sealing the stack in a continuous transverse direction of the sheet in the center portion thereof, and then cutting the stack between the ends of the sheets and the central portion to form a plurality of strips.

U.S. Pat. No. 4,114,224 issued Feb. 2, 1988 to E. Disko discloses a mop comprising plural absorptive elements comprising superposed flat layers of bonded non-woven fabric comprising a fibrous web and a binder. The fibrous web comprises at least about 50% by weight of hydrophilic fibers and the binder is present in about 25% to 100 % of the fibers, at about 50–400 grams per square meter. The binder is printed onto the fabric in the pattern. The non-woven fabric layers are joined along a medial spine, from which the layers are slit to the extremities thereof to form parallel flat strips ranging in width from about 15–40 millimeters and in length from about 20–60 centimeters.

U.S. Pat. No. 3,520,017 issued July 17, 1970 to T. V. Moss describes a mop swab including a multiplicity of absorbent mop cords which are secured together adjacent the ends of the swap by strands of thread or yarn which extend transversely to the swab in and among the mop cords. The mop cords may also be secured substantially centrally of the swab in a bunched-together relationship, by a canvass or fabric band.

It would be a significant advance in the art of mop head structures to provide a mop head having a significantly enhanced capacity for particulates and/or liquids, encompassing both dry mopping and wet mopping utility, relative to mop head structures of the prior art.

It is therefore an object of the present invention to provide such an improved mop head structure having utility for diverse dry mopping and/or wet mopping applications.

SUMMARY OF THE INVENTION

In one aspect, the present invention relates to a mop head comprising a plurality of web elements having involutions therein. These involutions may be formed by subjecting web elements to an involution-forming treatment such as (a) successive tensioning and detensioning conditions, (b) compression conditions, (c) differential stressing conditions, (d) twisting conditions, and (e) combinations of such conditions, e.g., twisting, stretching, and possibly pushing and pulling, whereby the web elements comprise such involutions therein.

The web elements employed in the mop head of the present invention may be of any suitable material of construction, as for example polymeric materials of synthetic character, or natural or synthetic fibrous materials, as well as blends, combinations, and composites thereof. Preferably, the web element is a fibrous web element, although it may be suitable to employ ribbons of thermoplastic materials or any other suitable web compositions in the broad practice of the present invention.

The mop head of the invention may be configured in the form of an array of loops of the fibrous web elements comprising the involutions, or the mop head may comprise an array of such groups and free ends retentively held in the array configuration by suitable structural means such as a clamp fitting or banding which in turn is coupleable to a mop handle to provide a complete mop device.

The fibrous web elements may be formed of any suitable material, such as woven or non-woven or felted webs, in any suitable material of construction, including cellulosic and synthetic materials, polymeric treated fibers, and blends thereof.

In another aspect, a mop head of the type broadly described hereinabove is impregnated with a dust-attracting substance, which may be lipophilic in character, and preferably is a wax or oil-based material.

In a further aspect, the further invention relates to a method of making a mop head, comprising the steps of:

providing web elements which are treatable to impart involutions thereto, e.g., which are formed of a material which under treatment conditions selected from the group consisting of (a) successive tensioning and detensioning conditions, (b) compression conditions, (c) differential stressing conditions, (d) twisting conditions, and (e) combinations of such conditions, form involutions therein;

subjecting the web elements to treatment conditions which form the involutions therein; and assembling an array of the involution-bearing web elements to form the mop head.

In respect of the method described immediately hereinabove, it will be appreciated that the assembly step of forming the web elements into an array may be carried out prior or subsequent to the step of subjecting the web elements to the involution-forming treatment conditions.

Other aspects and features of the invention will be more fully apparent from the ensuing disclosure and appended claims.

The present invention is based on the surprising and unexpected discovery that instead of relying on the use of finely divided or hollow fibers or randomly created, structurally unstabilized or otherwise haphazardly created structural regions, as do conventional mop materials, involutions may be formed in web elements and employed to substantially enhance the capacity of the web elements and mop head comprising same for pick-up, retention, and release of particulates and/or liquids. By such expedient, the mop head of the present invention is able to accommodate dry mopping as well as wet mopping applications. As used herein, the term "involutions" refers to deformations in the web element of the mop head constituting a deviation from the local planar character of the web. Accordingly, involutions in accordance with the invention include folds, wrinkles, creases, bends, curls, rolls, apertures, dimples, bosses and the like, which function to increase the holding or carrying capacity of the web elements for particles and/or liquids.

The web elements of the present invention thus are to be distinguished from the planar fibrous web elements employed in the mop head structures shown and described in the aforementioned U.S. Pat. Nos. 4,313,774 and 4,114,224.

In contrast to the anticipated deficiencies of the involuted web elements of the present invention, which would be expected to present a significantly reduced surface area to the surface or article being mopped by reason of the involutions, i.e., so that there would be expected to be less contact area for mopping of particulates and/or liquid, it has been unexpectedly discovered that the involutions in fact present an enhanced capacity matrix for take-up and retention of the particulates and/or liquids, which in addition function to readily release the collected particulates and/or liquids without undue effort. Further, it has been found that in wet mopping applications, the involutions function to promote evaporative drying of the mop subsequent to use, relative to mop heads comprising planar web elements, so that the mop is more quickly rendered dry for enhanced subsequent usage, relative to a corresponding mop head comprising planar web elements and containing liquid.

Involuted web elements of the mop head of the present invention are capable of taking up and retaining large amounts of particulates and/or liquids, utilizing relatively small amounts of structural material, as compared with conventional mop head structures comprising planar fibrous web elements. The latter mop heads are characterized by inherently low pick-up and retention capacity per unit of volume, which physically limits the amount of particulates and/or liquids which can be accommodated by the mop on a unit volume basis.

In addition, mop head articles comprising web elements of the present invention have been found in wet mopping applications to achieve an unexpectedly high extent of release of previously picked-up and retained liquids. For example, a mop head comprising involuted web elements of cotton, rayon, or wood pulp/synthetic blends typically release 80% to 90% of previously picked-up and retained liquid, as compared to 40% to 50% release levels which are characteristic of prior art mop heads of cotton or rayon spun yarn elements.

In a particular aspect of the invention, the web elements may be twisted into the form of elongate strands having involutions, or interstices, which provide a substantial capacity for particulates and/or liquid pick-up, retention and release, as compared to conventional mop head structures.

DETAILED DESCRIPTION OF THE INVENTION, AND PREFERRED EMBODIMENTS THEREOF

Figure 1:
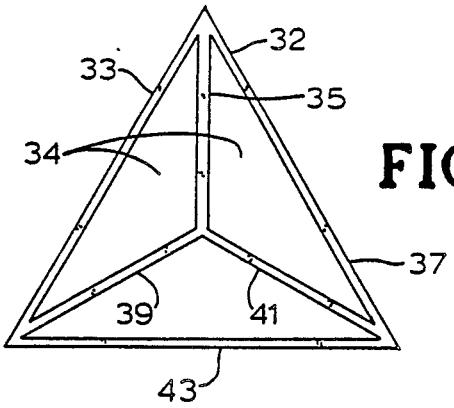
FIG. 1 is an elevational view of an interstitial region of a tetrahedral cell forming a sorptive structure according to an embodiment of the present invention.

With references to the drawings, FIG. 1 shows an elevation view of a tetrahedral cellular structure 32 defining an interior interstitial space 34 bounded by legs 33, 35, 37, 39, 41 and 43. The legs are structural elements which may be filamentous or filar in character and may be formed of materials such as rayon, blends, acrylic, polypropylene, cotton, metal, etc.

The resulting tetrahedral cellular structure when placed in proximity to a fluid such as water, organic solvent, etc., provides by virtue of its shape a region into which the fluid will flow by capillarity and surface tension effects. Thus, this structure is usefully employable in web elements comprising a mop head structure. The involutions provided by this structure are also advantageous in dry mopping applications, wherein the interior space of the cellular structure provides a locus for the take-up and retention of particulates, e.g., dust particles, sawdust, etc. It will be recognized that the shape of the cellular structure may be varied widely for wet mopping applications, depending on the viscosity, surface tension, and other physical characteristics of the fluid sought to be sorbed, as well as for dry mopping applications, depending on the size and character of the solid matter sought to be taken up and retained by the mop.

Figure 2:
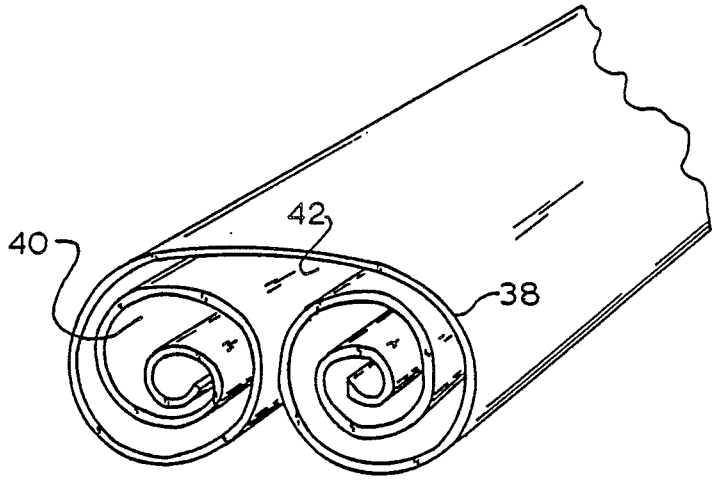
FIG. 2 is a perspective view of an absorptive filament showing its capacitive structure, according to one embodiment of the invention.

FIG. 2 shows a perspective view of a longitudinally extending web element (filament) 38, featuring involutions defining capacitive areas 40 and 42. Materials employed in the construction of this web element can be porous or nonporous materials, including, but not limited to, knitted or woven fabrics, incorporating plastics, metals, ceramics, cotton, rubber, etc., as a structural materials, so that when treated as herein described, the filament will form a continuous laterally involuted structure.

This laterally involuted web element 38 when placed in proximity to a fluid such as water, organic solvents, etc., provides by virtue of its shape a region into which the fluid will flow by capillarity and surface tension effects. When placed in proximity to a particulate, the web element provides the involutions as retention spaces for the particulates, which are able to pass into the capacitive areas defined by the involutions and to be retained, pending shaking, washing, or other removal step for disengagement of the particulates from the elongated web element. It will be recognized that the shape of the sorptive structure may be varied widely in wet mopping applications, depending on the viscosity, surface tension and other physical characteristics of the fluid sought to be sorbed, as well as in dry mopping applications, depending on the characteristics of the particulates sought to be taken up and retained by the mop comprising such elements.

The filament shown in FIG. 2 can for example be manufactured by introducing a ribbon of a knit material such as jersey onto two pairs of pull rollers with the first set revolving at a given speed and the second set revolving at some multiple thereof e.g., three times as fast, thereby stretching the material to or near, but not above, its elastic limit, and creating an imbalance in the internal forces present in the material, thereby causing the edges of the material to roll laterally inwardly into an involute form.

In an illustrative aspect, an involuted web element may be formed by the following steps:

(a) providing a web of a flexible material;

(b) unidirectionally stretching the flexible web to an extent in the vicinity of, but not exceeding,.the elastic limit of the web material; and (c) terminating the unidirectional stretching to impart involutions to the web, thereby forming the involuted web element.

An involuted web element may also be formed in the broad practice of the present invention by a process comprising:

(a) providing a web of flexible material; and (b) imparting collaterally imbalanced stresses to the material of the web, causing deformation of the web to yield involutions therein, and resulting in an involuted web element as the product article.

The filament web element shown in FIG. 2 can be manufactured in an alternative manner, by introducing a web of internally and collaterally prestressed material to a processing step which selectively relieves stress on only one side of the web, e.g., by passing the web into an appropriately designed infrared, ultrasonic, or radio-frequency heating apparatus, causing a net imbalance of stress forces to result, which in turn causes the edges of the web to roll into an involute form.

The filament structure shown in FIG. 2 can be manufactured in still another way, by introducing a web of internally stress-free material into a process which will induce stress on only one side of the web, such as by passing the web into an appropriately designed glass bead peening or shot peening apparatus, resulting in a net imbalance of stress forces, which in turn causes the edges of the web to roll inwardly into an involute form.

Figure 3:
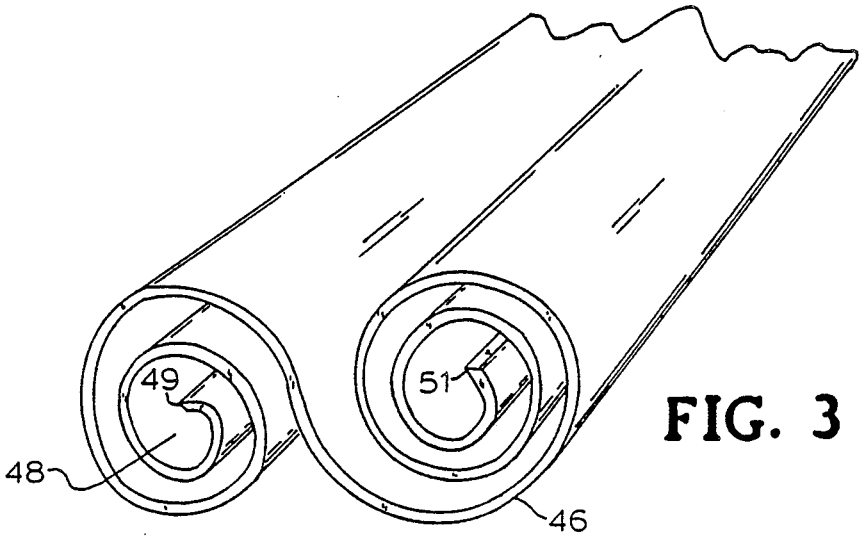
FIG. 3 is a perspective view of another embodiment of the invention.
Figure 4:
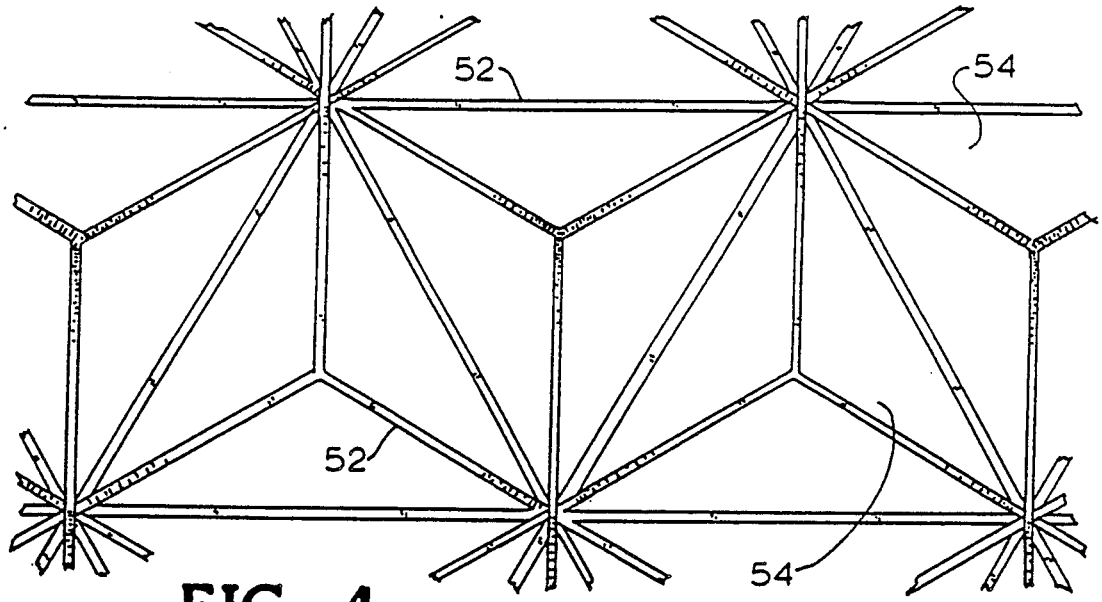
FIG. 4 is an elevational view of a lattice-like fabric, showing the three-dimensional characteristics thereof.
Figure 5:
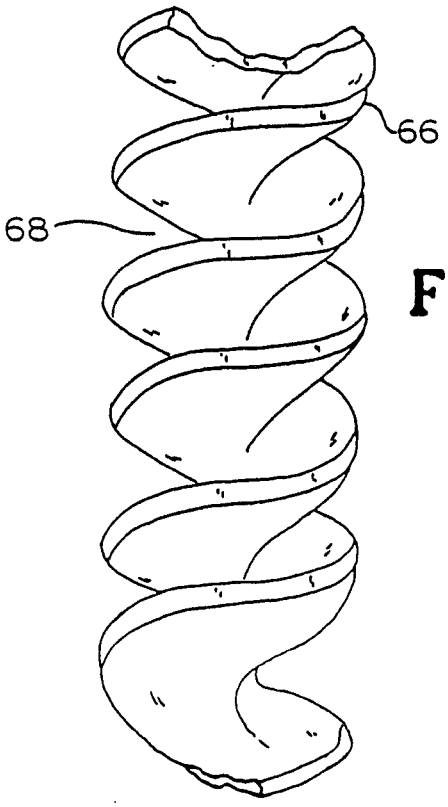
FIG. 5 is an elevational view of a helically extending ribbon comprising interstitial capacitive regions.

A similar effect may be accomplished in the formation of the structures shown in FIG. 2, 3, and 5, by employing composite web structures comprising laminated materials in which one side of the web is hydrophobic and the opposite side of the web is hydrophilic. If the hydrophilic side swells or bows laterally due to absorption of a liquid or due to weak magnetic interactions with a selected solvent or solute, the web will assume an involute form, and by tailoring the properties of the components of the composite web structure it is possible to selectively determine the degree of involutions and/or convolutions which will be responsive to various agents or reagents, liquids, fluids, heat, etc., and/or various processes and combinations thereof, and to create motile structures capable of involuting and de-involuting and also by proximity capable of rolling up and trapping a predetermined liquid or particulate material, and not involving and trapping another selected liquid or solid of different composition.

It should be recognized that the structural embodiments disclosed herein are applicable on a molecular as well as macroscopic scale, making it possible to design molecular structures which may be motile under certain conditions, and may be used to trap some predetermined molecule or molecules by involuting in proximity to it, thereby enclosing it. A filar structure of the type shown in FIG. 2, 3, and 5 can thus be used as specific molecular trap by approximately tailoring the shape and size of the interstitial space therein.

A mop head web element comprising a three-dimensional fabric may be constructed as a knitted fabric or may be built up from sheets of nonporous materials that have been embossed and perforated or molded into a series of component shapes that form the involutions, e.g., sorptive structures or solids trapping spaces, when the sheets or webs are stacked on one another. The structural material employed in this web element could be cellulose, plastic, wire of various metals, or even ceramic or other non-traditional mop head materials.

FIG. 5 is an elevational view of a longitudinally twisted ribbon-like filament 66 defining a capacitive structure with involutions 68 formed as a result of the coils of ribbon being brought into proximity with each other by virtue of its twisted structure. The resulting structure when placed in proximity to a fluid such as water, organic solvent, etc., provides by virtue of its shape a region into which the fluid will flow by capillarity and surface tension effects. In dry mopping applications, wherein the ribbon-like filament 66 is employed in a mop head comprising a plurality of such elements, the involutions 68 provide regions into which dust or other particulate material may be taken up and retained by the mop head.

Figure 6:
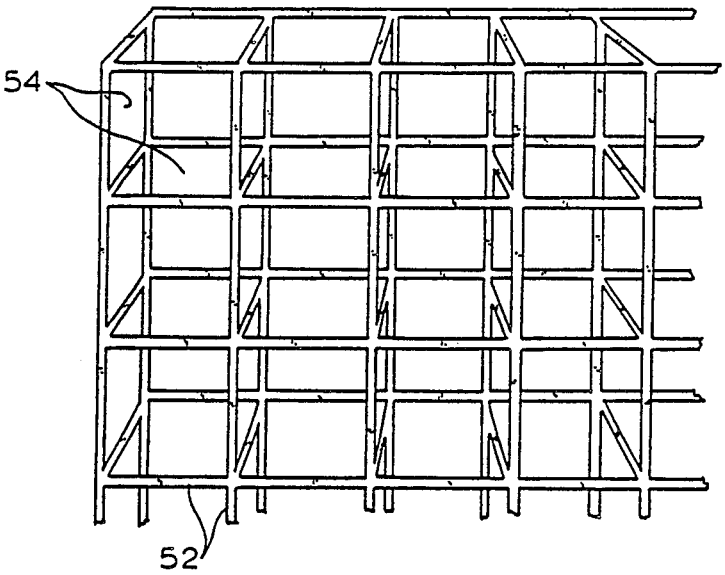
FIG. 6 is a perspective view of a capacitive absorptive filament according to still another embodiment of the invention.

FIG. 6 is a perspective view of a three-dimensional capacitive structure formed by the filar elements 52 defining a plurality of interstitial spaces 54 of cube-like configuration as involutions for take-up and retention of fluids and/or particulates. The filar elements may, for example, be of metal wire, or filaments of a thermoplastic material, or any other natural and/or synthetic material.

Figure 7:
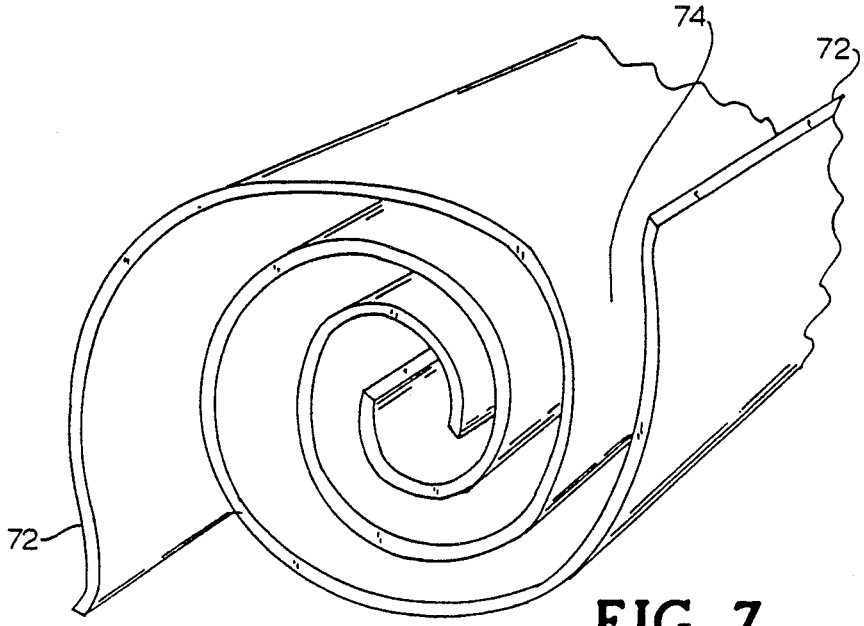
FIG. 7 is a perspective view of an involuted interposed web element, comprising interleaved web structures forming interstitial capacitive regions therebetween.

FIG. 7 shows a perspective view of an involuted interposed reactive element, comprising interleaved elongate web elements 72 forming interstitial capacitive regions 74 as the involutions therebetween. The resulting structure when placed in proximity to a fluid such as an electrolyte, or some chemically reactive fluid, etc., provides by virtue of its shape an involution region 74 into which the fluid will flow by capillarity and surface tension effects. The individual leaves may be required for the construction of a battery, for example. In mopping applications, the involutions 74 provide capacitive spaces accommodating the take-up, retention, and release of particulates and/or fluid, for wet mopping as well as dry mopping applications.

Figure 8:
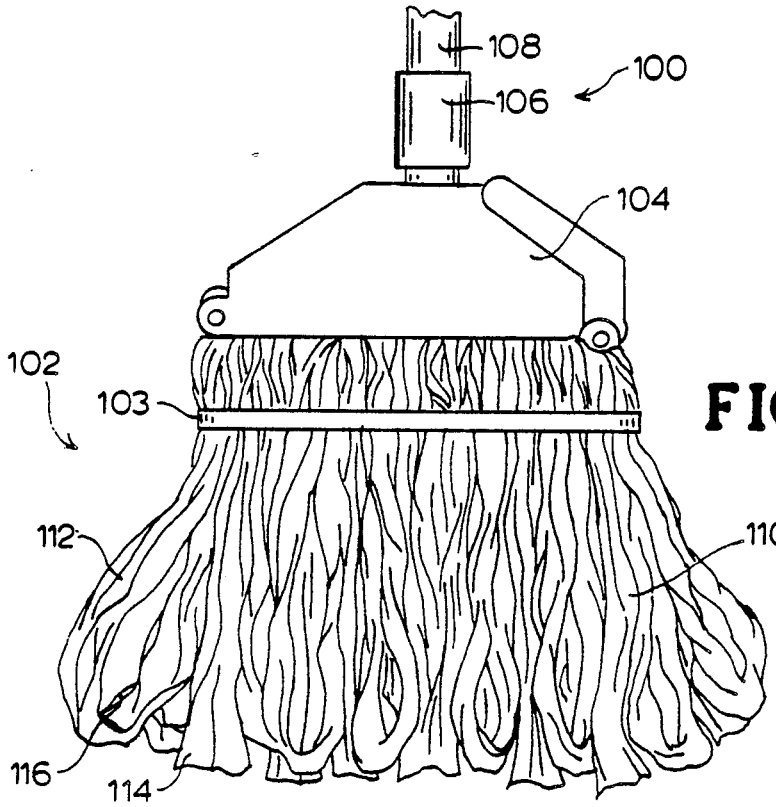
FIG. 8 is a perspective view of a mop head according to one embodiment of the present invention, comprising both looped and free ended fibrous web elements.

FIG. 8 is a perspective view of a mop 100 comprising a mop head 102 which is joined by means of a gathering band 103 and retention yoke 104 and associated handle fitting 106 to handle 108 of the mop.

The mop head 102 as shown comprises a plurality of web elements 110 having involutions 116 therein. The web elements may for example comprise elongate twisted ribbons of fabric or other material which is treatable to form involutions therein, such as for example by (1) successive tensioning and detensioning conditions, (2) compression conditions, (3) differential stressing conditions, (4) twisting conditions, and (5) combinations of such conditions. Alternatively, the web elements may be formed of a material, e.g., an apertured non-woven fabric, which is intrinsically constructed with involutions.

These web elements may be formed of any suitable material of construction, as for example cellulosic materials, polymeric materials, synthetic resins, and any other natural or synthetic materials, and blends, combinations, and composites thereof. The web may suitably be fibrous in character, and comprise a woven or non-woven fabric of suitable composition. Preferred fiber materials include cotton, olefin, and polymeric fibers, polyesters, polypropylene, rayon, acrylics, rayon/-polyester blends, cellulosic material such as wood pulp, wood pulp/polyester blends, etc. A highly suitable material for such web elements is a cellulose and synthetic resin fiber blend, including materials which are commercially available under the trademark SONTARA® from E. I. DuPont De Nemours and Company (Wilmington, Del.), including polyester, polyester/rayon blends, wood pulp/polyester blends, and aramid materials. Of these materials, which are spunlaced fabrics, a material comprising a 55%/45% by weight wood pulp/polyester blend, available as SONTARA® 8801 and 8818 are particularly preferred, since this material has a high sorptive capacity in wet mopping applications, as well as good dry mopping properties for dust mopping and the like. In general, the non-woven materials which may be usefully employed in web elements according to the present invention include any suitable configuration or structural type of non-woven materials, including melt-blown, spunlaced, spun-woven, spun-bonded, hydroentangled, etc. materials.

Other non-woven materials which may be usefully employed in web elements in mop head articles of the present invention include the non-woven materials available under the following trade names: "Omega", "Webril", "Alpha", "Curity", "Kendall", and "Webcol" (Veratec [International Paper/Kendall]); "Assure", "Hydrospun", and "Dextex" (Dexter); "Likerag", "Reddrags", and "Busboy" (IFC); "Key Bak", "Solventwipe", "Chix-Plus", and "Duralace" (Chicopee); "Ultra Wipe" and "Sure Wipe" (Fort Howard); "Handiwipes" (Colgate/Polmolive); "Kimtex" (Kimberly-Clark); "Scott Cloth" (Scott Paper); "Nexus and Softspun" (Precision Fabrics Group, Inc.); and "Vilmed" (Freudenberg).

As shown in FIG. 8, the mop head 102 features the fibrous web elements 110 in the form of loops 112 as well as free ends 114. It will be recognized that the mop head may be configured solely as an array of loops, or alternatively as solely an array of free ends. In any event, the web elements of the mop head feature involutions 116 therein, which may take the form of creases, folds, wrinkles, bends, and the like, whereby a structure with pockets, crevices, interstices, etc., is provided. The resulting mop head may be fabricated in any suitable manner, as for example by tensioning and then detensioning the web elements, to form the involutions, or by compressing the web elements to form involutions therein, or by a combination of such procedures, or by any other procedure or treatment conditions which impart involutions to the web elements.

In a preferred embodiment, the fibrous web elements of the mop head shown in FIG. 8 may be originally produced as edge cuttings or waste trimmings from the manufacture of garments such as surgical gowns, wash cloths, wipes, or the like. Such cuttings or trimmings, which are of continuous elongate form, may be tensioned and then relaxed to impart the involutions to the fabric, followed by cutting into suitable lengths or otherwise folding the elongated cuttings or trimmings into loops or other suitable configuration, to form the mop head structure.

Figure 9A:
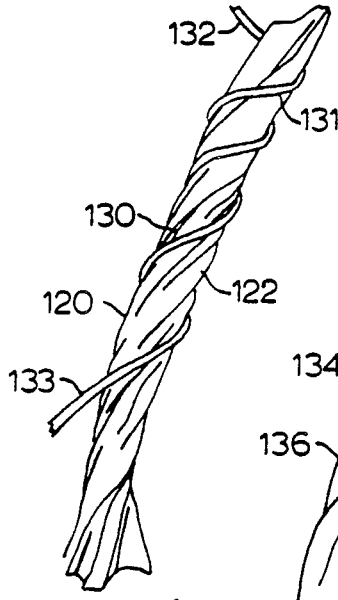
FIG. 9A, 9B, and 9C are perspective views of twisted strands of web materials suitable for use as web elements in mop head articles of the present invention.

FIG. 9A is a perspective view of a fibrous web element 120 which may be employed as an element of a mop head, in combination with plural elements of the same type. The fibrous web element 120 as shown is elongated in form and is helically twisted, as at twist 122, to form a generally helically wound web element having a plurality of involutions 130 along its lengths, so that the respective web elements form strands or "ropes" of the fibrous materials. This element may be folded at a medial portion (not shown), and then suitably clamped or otherwise secured in a mop head together with a plurality of other web elements of similar type, to form loops, or alternatively a plurality of strands as shown may simply be gathered at one end and clamped or otherwise secured in a mop head array.

As a variant embodiment, the helically twisted fibrous web element shown in FIG. 9A may be bound by a circumscribing filament 131, with the respective free ends thereof 132 and 133 being suitably tied or otherwise secured, so that the helically twisted web element is retained in a "tightly bundled" twisted configuration. Alternatively, the helically twisted web element may be retained in position by spot bonding, such as by dispersing an adhesive in droplet or other discontinuous form throughout the web element prior to helically twisting same, so that the resulting structure is bonded throughout its volume at discrete separate points, whereby the web element retains its structural integrity in the helically twisted form. It will be appreciated that a variety of binders, adhesives, and bondants may be employed for such purpose, depending on the character and composition of the web element and the intended use applications of the mop head in which such web element is to be employed. It may also be desirable in some instances to pattern print an adhesive or other bondant material onto the web element after it is helically twisted. For this purpose, heat-activated adhesives may desirably be employed, which are "set" at elevated temperature subsequent to application to the twisted web element. In other instances, it may not be necessary to bond or helically wrap the helically twisted element, if it will maintain its twisted shape throughout its service life.

It will be appreciated that the web element shown in FIG. 9A may be constructed of the same type of materials of construction as the ribbon-like filament of FIG. 5 hereof, and that the pitch and number of twists or turns per unit length may be widely varied in each, depending on the specific material of construction and the intended end use application.

Figure 9B:
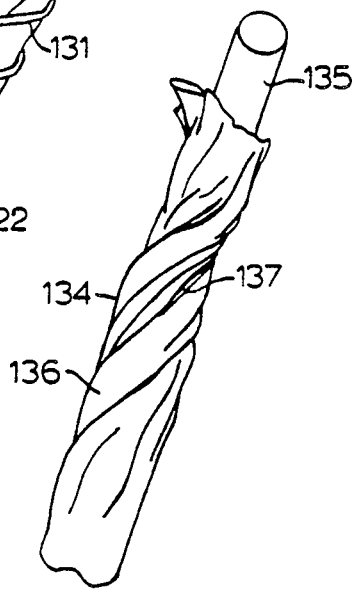

FIG. 9B is a perspective view of an alternative involuted web element 134, comprising a foam or other flexible material core 135, surrounding which is a helically twisted fabric or other covering 136, having involutions 137 therein.

Figure 9C:
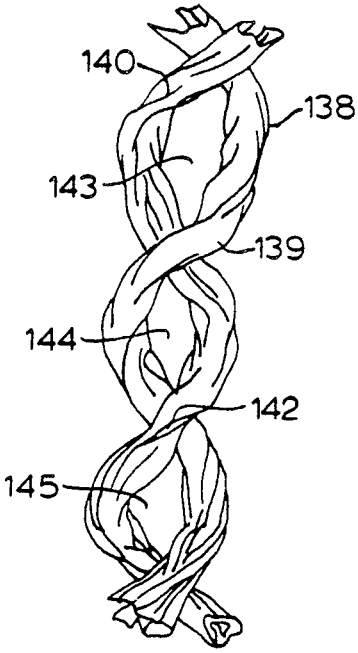

FIG. 9C is a perspective view of another web element structure 138 which may be employed in the broad practice of the present invention. This web element structure comprises interbraided (and individually twisted) web elements 139 and 140, each of which may be of a type as shown in FIG. 9A. It will be appreciated that in addition to involutions 142 which are provided on the surfaces of these respective web elements, their interbraided structure also produces a series of interstitial regions 143, 144, and 145, which are capacitive in character and thus provide additional involutions for pick-up, retention, and selective release of solid particulates and/or or fluids.

The web elements employed in the broad practice of the present invention may have any suitable dimensional characteristics, however web elements having a diameter or lateral dimension of from about 1/16 to about 3.0 inches, more preferably from about ⅛ to about 1.6 inches, and most preferably from about ⅜ to about 1 inch, may generally be employed to good advantage.

Figure 10:
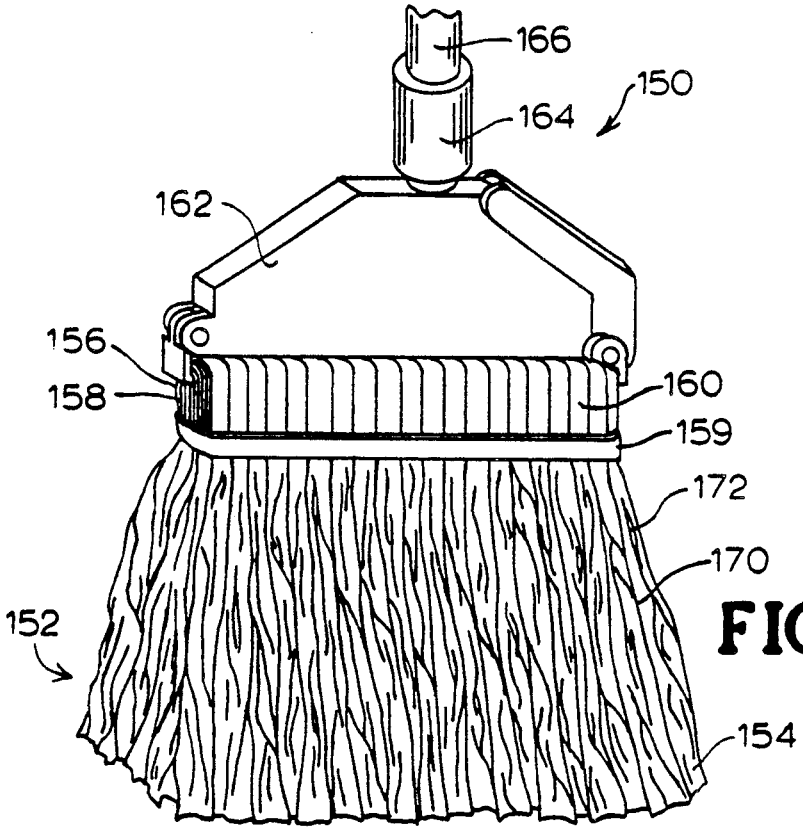
FIG. 10 is a perspective view of a mop comprising a mop head according to another embodiment of the invention, comprising twisted strand web elements.

FIG. 10 shows an alternative embodiment of a mop 150 comprising a mop head 152 which is formed of a plurality of fibrous web elements 154 formed from respective superposed sheets, e.g., 156 and 158, with the array of superposed sheets being folded at a medial region 160 and secured at such medial region by a gathering band 159 and yoke 162 or other retention means. The yoke 162 in turn is joined to a handle fitting 164 into which a handle 166 is secured, to complete the mop structure.

The superposed sheets 156, 158 in the mop head 152 are longitudinally slit to form web element edges 170 and are treated or otherwise configured to provide involutions 172 therein. For example, the web elements may be subjected to longitudinal tensioning followed by relaxation of the tensioning force to impart involutions 172 to the web elements. The longitudinal stretching and relaxation may be carried out at any suitable point of the manufacturing process, as for example prior to superposition of the constituent sheets, or after the sheets are superposed and before the sheets are longitudinally slit to form the discrete web elements, or after slitting of the web elements, or in any other manner serving to impart the desired involutions to the web elements as employed in the final mop head product.

The web elements in the FIG. 10 mop preferably are fibrous in character and may comprise a composition such as 100 % rayon, cotton, or polyester blends, 100 % polyester, 70%/30% by weight rayon/polyester blends, or 55%/45% wood pulp/polyester blends. Such materials are illustratively described, it being recognized that the web elements can be formed of any suitable material which has involutions therein or else is capable of having involutions imparted thereto, and is of appropriate character for the mopping application intended for the mop head article.

Figure 11:
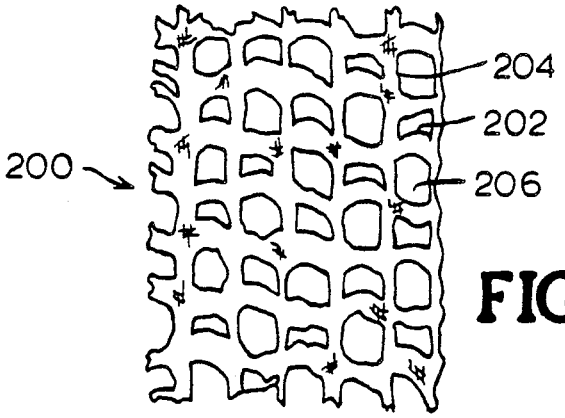
FIG. 11 is a plan view depiction of an apertured non-woven fabric, such as may be employed in web elements of a mop head article according to the present invention, and wherein the apertures define interstitial capacitive regions constituting involutions in the web elements.

FIG. 11 is a plan view representation of an apertured non-woven fabric 200, such as may be usefully employed to form web elements of a mop head article according to one embodiment of the present invention. As shown, the non-woven fabric comprises generally horizontally aligned strand members 202 and generally vertically aligned strand members 204, corporately defining a criss-crossed lattice having apertures 206 therein. These apertures define interstitial capacitive regions constituting involutions of the fabric, which may be employed to effective advantage in web elements of a mop head structure, e.g., such as is shown and described with reference to FIGS. 8 and 10 hereof, to accommodate the pick-up, retention, and selective release of particulates and/or fluids when such fabric is employed in web elements of a mop head structure.

Apertured non-woven materials are generally of two main types, hydroentangled (spunlaced), and resin-bonded (water hold). These materials are well-known and readily commercially available, from manufacturers such as E. I. DuPont De Nemours & Company, Inc.; Chicopee; Veratec (International Paper/Kendall); and Fort Howard. Such apertured non-woven materials may be utilized in the form of unshaped strips, as the web elements of a mop head according to the present invention. Alternatively, such strips may be twisted, stretched, creased, folded, or otherwise configured or treated to introduce additional involutions thereto. By way of example, such non-woven fabrics could be employed to form web elements of the type shown and described with reference to FIGS. 9A, 9B, and 9C hereof.

In order to enhance fluid take-up and retention capacity in wet mopping applications, the mop head of the present invention may comprise web elements having associated therewith any of a variety of sorption-enhancing materials or additives. For example, in a single-use mop application, the web elements may be impregnated or otherwise have associated therewith a super-absorbent material. Such super-absorbents, or hydrogels, may be of any suitable type, and are readily commercially available from a variety of sources, including the products available under the following trade names: "Favor" super-absorbent powder (Stockhausen, Greensboro, N.C.); "Sanwet" super-absorbent powder (Sanyo, Kyoto, Japan); "Aridall" super-absorbent polymer (Chemdal); "Aquasorb" sorbent (Aqualon, Wilmington, Del.) "SuperSorb" (Super Absorbent Company, Lumberton, N.C.); and "DryTech" super-absorbent (Dow Chemical Company, Midland, Mich).

In order to enhance the particulate take-up and retention capacity in dry mopping applications, the mop head of the present invention may be treated with a suitable particulate-retention enhancing substance, such as a lipophilic or oil-based material. Examples include paraffinic oils, mineral oils, waxes, etc. In general, any substance or composition which is effective to enhance the particulate take-up and/or retention capacity of the mop head, and which is otherwise compatible with the mop head materials of construction and materials to be encountered in the mopping application, may be suitably employed. Hydrophilic as well as hydrophobic materials of such type may be employed, to the extent that same are effective to enhance the dry mopping capability of the mop head. Examples of dry mopping enhancement agents which may be potentially usefully employed on mop heads according to the present invention include formaldehyde resins, linseed oil, emulsified wax formulations, static cling treatment substances, anti-bacterial coatings of various types, and chemicals and formulations providing such a dry mopping enhancement function when impregnated or otherwise applied to the web elements of the mop head.

A potentially usefully employed treatment for enhancing the particulate take-up, retention, and release capacity of the web elements of the mop head is a mop treatment composition commercially available as DUSTROI BACTERIOSTATIC mop treatment, available from GOLDEN STAR INC. (North Kansas City, Mo.). Other mop treatment agents which may be usefully employed for such purpose in the broad practice of the invention include those available under the following trade names: "Sanco Treat" (Sanitary Products Corp.); "Aqua Mist" (I. Schneid, Inc.); "Aqua Sheen" (James Varley & Sons, Inc.); "Aqua-Treat" (Perma, Inc.); "Clean-Sheen" (Magee Industrial Division); "Cen-Dust" (Cental Chemical Company); "D-Dust" (Oil Specialties & Refinery Co., Inc.); "Duf" (Hysan Corp.); "Dy-Dust" (The Davis-Young Company); "Dust-Loc" (Tu-Way Products Co.); "Dust-n-Shine" (Wilen Manufacturing); "Floor Sheen" (James Varley & Sons, Inc.); "Guardian" (ABCO, Inc.); and "Noil" (Betco Corp.).

With respect to bacterial properties of web elements which may be employed in accordance with the present invention, it is to be appreciated that the materials of construction of the web elements may be selected so as to provide an intrinsic bacterial barrier. For example, wood pulp in the form of tissue can be coentangled with polyester to form a wood pulp rich composite fabric that is very effective as a bacterial barrier.

It will be further appreciated that mop heads according to the present invention may be treated with or comprise any other suitable materials, additives, treatment agents, and the like, which do not preclude the efficacy of the mop head for its intended purpose. Examples of such additional materials include flame retardants, surfactants, antioxidants, binders, reinforcing agents, pigments, etc.

While the invention has been shown and described with a respect to illustrative embodiments, aspects and features, it will be recognized that numerous variations, modifications, and other embodiments are possible within the broad scope of the present invention, and all such modifications, variations, and other embodiments therefore are to be regarded as being within the spirit and scope of the invention.

What is claimed is:

1. A mop head comprising a unitary array of plural web elements, comprising elongate web element strands having involutions therein formed by differential stressing of elongate web element strips to a sufficient extent to permanently impart said involutions thereto and form said elongate web element strands therefrom, with said strands having a reduced transverse dimension relative to said elongate web element strips.

2. A mop head according to claim 1, wherein said involutions are formed by subjecting said elongate web element strips to an involution-forming treatment selected from the group consisting of (a) longitudinal stretching of the elongate web element strips (b) longitudinal twisting of the elongate web element strips and (c) combinations of such conditions.

3. A mop head according to claim 1, comprising an array of loops of said web elements.

4. A mop head according to claim 1, comprising an array of free ends of said web elements.

5. A mop head according to claim 1, comprising an array of loops and free ends of said web elements.

6. A mop head according to claim 1, wherein said web elements are fibrous web elements.

7. A mop head according to claim 1, wherein said web elements are formed of a material comprising a cellulose and synthetic resin fiber blend.

8. A mop head according to claim 1, wherein said web elements are formed of a fabric.

9. A mop head according to claim 1, wherein said web elements are formed of a woven fabric.

10. A mop head according to claim 1, wherein said web elements are formed of a non-woven fabric.

11. A mop head according to claim 1, wherein said web elements are formed of a material selected from the group consisting of cotton, olefin, nylon, acrylic, polymeric, polyester, polypropylene, rayon, acrylics, wood pulp, and composites, combinations, and blends thereof.

12. A mop head according to claim 1, wherein said web elements are formed of a material selected from the group consisting of polyester, rayon, cotton, and polymeric materials.

13. A mop head according to claim 1, wherein said web elements are formed of a material selected from the group consisting of rayon/polyester blends, cotton/polyester blends, and polymeric blends.

14. A mop head according to claim 1, wherein said web elements are formed of a wood pulp/polyester blend.

15. A mop head according to claim 1, wherein said web elements are in the form of generally helically twisted ribbons of non-woven fabric.

16. A mop head according to claim 1, wherein said elongated web element strands are formed of an apertured non-woven fabric comprising generally horizontally aligned strand members and generally vertically aligned strand members, corporately defining a criss-crossed lattice having apertures therein, whose apertures defined at least a portion of said involutions.

17. A mop head according to claim 1, wherein the elongate web element strands are formed of woven fabric ribbon, which has been longitudinally stretched and twisted into an involution-bearing condition.

18. A mop comprising a mop head according to claim 1.

19. A mop head according to claim 1, which has been treated by application thereto of an agent for enhancing the particulate take-up and/or retention capacity of the mop head.

20. A mop head according to claim 19, wherein the transverse dimension of the elongate web element strands is from about 1/16 inch to about 3 inches.

21. A mop head according to claim 19, wherein the agent for enhancing the particulate take-up and/or retention capacity of the mop head is selected from the group consisting of paraffinic oils, minerals, waxes, formaldehyde resins, linseed oil, emulsified wax formulations, static cling treatment substances, anti-bacterial coatings, and combinations thereof.

22. A mop head according to claim 1, wherein the elongate web strips comprise edge waste trimmings from fibrous material articles manufacture.

23. A mop head according to claim 1, wherein the involutions of the elongate web element strands are selected from the group consisting of creases, folds, wrinkles, twists, bends, and combinations thereof.

24. A mop head according to claim 1, wherein the involutions are formed by longitudinally stretching the elongate web element strips, and then discontinuing such longitudinal stretching.

25. A mop head according to claim 1, characterized by fluid releasability of at least 80% of water which is picked up and retained by the mop head.

26. A mop comprising a unitary array of plural web elements comprising elongate web element strips of an apertured non-woven fabric comprising generally horizontally aligned strand members and generally vertically aligned strand members, corporately defining a criss-crossed lattice having apertures therein, wherein the apertured non-woven fabric is formed of a material selected from the group consisting of spunlaced materials and resin-bonded materials.

27. A mop head comprising a unitary array of plural web elements comprising elongate strips of edge waste trimming stock formed of a non-woven material, which have been longitudinally stretched to yield strands of reduced transverse dimension having involutions therein resulting from such longitudinal stretching, wherein said involutions comprise shaped regions of said longitudinally stretched strands into which fluid is flowable by capillarity and surface tension effects, and which provide a locus for take-up and retention of particulates, when contacted with fluid and/or particulates.

* * * * *